United States Patent [19]

Drop et al.

[11] 4,001,626

[45] Jan. 4, 1977

[54] HIGH PRESSURE TIN HALIDE DISCHARGE LAMP

[75] Inventors: Peter Cornelis Drop; Willy Joseph Catharina Endevoets; Antonie Peter Lambertus van Eijl; Alexander Gray Jack, all of Eindhoven, Netherlands

[73] Assignee: U. S. Philips Corporation, New York, N.Y.

[22] Filed: Nov. 8, 1974

[21] Appl. No.: 522,057

[30] Foreign Application Priority Data

Nov. 26, 1973 Netherlands ..... 7316101

[52] U.S. Cl. ..... 313/229; 313/155

[51] Int. Cl.[2] ..... H01J 61/18

[58] Field of Search ..... 313/229, 155

[56] References Cited

UNITED STATES PATENTS 3,398,312 8/1968 Edris et al. ..... 313/229 X

FOREIGN PATENTS OR APPLICATIONS 1,142,511 2/1969 United Kingdom 1,283,152 7/1972 United Kingdom

*Primary Examiner*—Palmer C. Demeo

*Assistant Examiner*—Darwin R. Hostetter

*Attorney, Agent, or Firm*—Frank R. Trifari; Robert S. Smith

[57] ABSTRACT

A high pressure tin halide discharge lamp having a discharge vessel containing a quantity of rare gas as a starter gas and for each cubic cm of contents of the discharge vessel between 0 and 50 mg of mercury and at least 1 μmol of at least one of the halides of tin. Furthermore the discharge vessel contains at least one of the elements indium, bismuth, lead, gallium and zinc or halides thereof to correct the color point of the radiation emitted by the lamp.

7 Claims, 2 Drawing Figures

HIGH PRESSURE TIN HALIDE DISCHARGE LAMP

The invention relates to a high pressure tin halide discharge lamp having a discharge vessel provided with electrodes between which the discharge is maintained during operation and comprising a quantity of rare gas as a starter gas and furthermore per cubic cm of contents of the discharge vessel between 0 and 50 mg of mercury and at least 1 $\mu$mol of at least one of the halides of tin (with the exception of fluoride).

Efficient light sources having a high intensity are high pressure mercury vapour discharge lamps that have been used for a long time in large numbers, for example, for street lighting, factory lighting and the like. A drawback of these lamps is that the spectral distribution of the emitted visible radiation mainly consits of lines in the blue, green and yellow regions of the spectrum so that a poor rendition of colours is obtained with these lamps. An improvement of both the colour rendition and also the efficiency of the high pressure mercury vapour discharge lamp is possible by adding, in addition to mercury, one or more metal halides to the lamp filling (see U.S. Pat. No. 3,234,421). A combination of metal halides often used in practice for such a high pressure metal halide discharge lamp is sodium iodide thallium iodide and indium iodide. The spectral distribution of the radiation emitted by these lamps mainly consists of lines originating from the added metals, which lines are found inter alia over the entire visible part of the spectrum. If strict requirements are imposed on the colour rendition, for example, in case of interior lighting the said metal halide-containing lamps are less suitable, because in such cases a continuous spectral distribution of the radiation emitted by the lamp is desirable.

High pressure metal halide discharge lamps comprising mercury and tin halides, notably tin chloride and tin iodide are known from German Patent application No. 2,023,770. The radiation emitted by these lamps mainly originates from tin halide molecules and has a very broad, continuous spectral distribution. As a result of this continuous spectral distribution the colour rendition of these lamps is very satisfactory. Generally, values of the colour rendering index $R_a$ (mean value of the rendition indices for 8 test colours as defined by the Commission Internationale de l'Eclairage) of up to approximately 85 are achieved. The radiation efficiency of these lamps and also the colour temperature of the emitted radiation are dependent on the chlorine-iodine ratio used at a constant total halogen concentration. High efficiencies, for example, to 1m/W are obtained at high values of the said chlorineiodine ratio, which is accompanied by high colour temperatures, for example, 5500K. For many practical uses, for example, for interior lighting considerably lower values of the colour temperature, for example, 4000K or less are desired. This can be partly achieved with the known lamps by choosing the chlorine-iodine ratio to be low. This has, however, the drawback that the radiation efficiency then becomes low.

Tin halide-containing discharge lamps are furthermore known from Netherlands Patent application No. 6610396. In this application particularly lamps are described which comprise tin bromide and tin iodide. These lamps also have the drawback that a high radiation efficiency is accompanied by a high colour temperature (namely at high values of the bromine-iodine ratio).

In the Netherlands Patent application No. 7303079 not yet published the Applicant proposes to add to high pressure tin halide discharge lamps a small quantity of lithium halide (with the exception of fluoride) which may be optionally replaced by not more than 50 mol % of sodium halide (with the exception of fluoride). As a result the desired low colour temperature is reached, also for high chlorine-iodine and bromine-iodine ratios. The high radiation efficiency is then maintained and an increase in the colour rendering index is obtained. A particular advantage of the addition of lithium halide and also that of sodium halide is that the lamps have a better colour aspect, that is to say, the colour point of the radiation emitted by the lamp in the colour gamut ($x$, $y$-C.I.E, plane of co-ordinates) is shifted to a place located more closely to or located on the curve of the black bodies.

An improvement of the colour aspect of the tin halide discharge lamps is generally very desirable. In fact, these lamps may have a green colour aspect which is found to be disturbing, also in case of a very good colour rendition. This colour aspect deviating from white light is particularly a drawback in lamps having a low colour temperature of the emitted radiation. The above described possible correction of the colour aspect with mainly lithium halide has the drawback that this halide may attack the lamp parts during the lifetime of the lamp. Furthermore it has been found that after some time the lithium halide may disappear entirely or partly. These drawbacks can only be solved if in the lamp manufacture extra steps are taken which make the lamp of course more expensive. Colour point correction with sodium halide has the drawback of an inadmissible decrease of the colour rendering index.

The object of the invention is to provide a high pressure tin halide discharge lamp having an improved colour aspect and in which the drawbacks of the described use of lithium halide or sodium halide are obviated. A further object of the invention is to provide a construction of such a lamp with which low colour temperatures in combination with both a satisfactory colour point and a high efficiency and a satisfactory colour rendition can be obtained.

A high pressure tin halide discharge lamp according to the invention has a discharge vessel provided with electrodes between which the discharge is maintained during operation and comprises a quantity of rare gas as a starter gas and furthermore per cubic cm of contents of the discharge vessel between 0 and 50 mg of mercury and at least 1 $\mu$mol of at least one of the halides of tin (with the exception of fluoride) and is characterized in that the discharge vessel comprises at least one of the elements indium, bismuth, lead, gallium and zinc as such or in the form of at least one of the halides (with the exception of fluorides) of the said elements in a quantity effective for correction of the colour point of the radiation emitted by the lamp.

A lamp according to the invention has a discharge vessel of light-transmitting material, for example, quartz. Electrodes between which the discharge takes place during operation are provided in the discharge vessel. To ignite the lamp easily the discharge vessel is filled with a small quantity of a starter gas consisting of one or more rare gases, for example, up to a pressure of some to several dozen Torr. The discharge vessel is provided with at least one tin halide. One or more of the compounds tin chloride, tin bromide and tin iodide may be used as a tin halide. Tin fluoride is not suitable due to its great aggressiveness. Tin halide is used in a quantity of at least 1 μmol per cubic cm because at lower dosages too little tin halide continuum radiation is emitted by the lamp. The maximum admissible quantity of tin halide is greatly dependent on the lamp construction. If the lamp has a discharge stabilized by the wall of the discharge vessel the upper limit for the tin halide dosage is generally a value of approximately 10 μmol per cubic cm because an unstable discharge arc is obtained with larger quantities of tin halide in the conventional vertical operating position of the lamp. Larger dosages are possible in other lamp constructions, for example, in lamps having a discharge stabilized by the electrodes. In addition to the halogen present in the form of tin halide, the lamp may comprise a slight excess of halogen. In practice an excess of tin is often used (above the quantity which is sufficient to bind the halogen to tin dihalide) because then the thermodynamic stability of the lamp filling is enhanced. The discharge vessel may further more be provided with a quantity of mercury which is completely evaporated in the operating condition in order to give the lamp a sufficiently high power. If a lamp according to the invention comprises mercury, its quantity is not more than 50 mg per cubic cm.

To correct the colour point of the radiation emitted by a lamp according to the invention and thus to obtain an improvement of the colour aspect of this radiation, at least one of the elements indium, bismuth, lead, gallium and zinc is added to the lamp filling. The emission spectrum of a lamp according to the invention has, in addition to the tin halide continuum, emission lines which originate from the said elements and are predominantly located in the blue part of the spectrum. As a result the colour point of the radiation emitted by the lamp is shifted in the direction of the curve of the black bodies and the lamp loses its troublesome green colour aspect. An additional result of the addition of the said elements is a slight increase of the colour temperature of the emitted radiation.

A lamp according to the invention has the advantage that the elements used for correction of the colour point are not aggressive and do not attack the lamp parts. As compared with the known lamps, which have no extra elements for colour point correction, the lamps according to the invention have higher values for the colour rendering index while maintaining the high efficiency, which is of course very advantageous.

It has been found that the said elements for colour point correction according to the invention can be used as such or in the form of iodides, chlorides or bromides. Furthermore it has been found that already very slight quantities of the said elements have a favourable influence on the colour point.

A very satisfactory colour aspect is obtained with lamps according to the invention comprising per cubic cm of contents of the discharge vessel between 0.01 and 10 μmol of at least one of the said elements indium, bismuth, lead, gallium and zinc. Quantities of more than 10 μmol per cubic cm are not used in this preferred embodiment so as to prevent suppression of the tin halide continuum spectrum.

Lamps according to the invention comprising at least one of the elements indium, gallium and zinc are preferred. In fact, it has been found that these elements yield optimum results as regards colour point correction.

For practical uses it is often very desirable to have high pressure tin halide discharge lamps having a low colour temperature of the emitted radiation, for example, less than 4000 K. As is known, low values of the colour temperature can be achieved if the tin halide in the lamp consists entirely or partly of tin iodide. These tin iodide lamps have, however, a relatively low efficiency and in practice tin chloride and/or tin bromide is often added to the lamp filling. It has been found that at a constant ratio between the concentration of chlorine and/or bromine and the concentration of iodine favourable for the efficiency of the lamp very low values (to less than 3000 K) of the colour temperature can be achieved if the total halogen concentration is to be chosen high enough. A satisfactory colour rendition is obtained with such high-dosage lamps. It has, however, been found that in exactly these lamps having a low colour temperature the distance between the colour point of the emitted radiation and the curve of the black bodies is relatively large so that an unacceptable colour aspect is obtained. The step of colour point correction according to the invention may therefore be very advantageously used in lamps having a high halogen concentration.

Another practical drawback excluding the use of high tin halide concentrations (for example, more than 10 μmol per cubic cm) in the construction most conventional so far, in which the lamp is operated vertically and the discharge is stabilized through the wall of the discharge vessel, is that the discharge arc is unstable at such high halide concentrations. The said instability is found to disappear if such a high-dosage lamp is placed in a horizontal operating position (i.e. with the axis of the discharge in a horizontal plane). Then, however, a strong upward curvature of the discharge arc is obtained so that the wall of the discharge tube is locally overloaded to a great extent and the lamp becomes defective after a short time. It is known (see for example Austrian patent specification No. 264,662) that a curved discharge arc can be centered in the axis of the discharge vessel again by applying a suitable magnetic field. It has been found that the required magnetic field for high pressure tin halide discharge lamps is relatively weak so that a simple construction in which the current supply for the lamp is passed one or more times around the discharge vessel (and parallel to the lamp axis) can be used. The magnetic field then occurring is determined by the number of conductors conveying the lamp current, the distance between these conductors and the lamp axis and by the lamp current.

In view of the foregoing such a high pressure tin halide discharge lanp which is colour-point corrected according to the invention is preferred, which comprises tin chloride, tin iodide and furthermore optionally an excess of tin in which the halogen-tin ratio has a value of between 0.1 and 2.5 and the chlorine-iodine ratio has a value of between 0.25 and 4 and which is characterized in that the total quantity of tin halide has a value of between 5 and 50 μmol per cubic cm of contents of the discharge vessel, wherein the lamp is suitable for horizontal operating position and is provided with at least two current conductors which are substantially parallel to the lamp axis and through which the lamp current flows and provide for the current supply of the lamp so that during operation the lamp is placed in a magnetic field preventing the upward curvature of the discharge arc.

The preferred embodiment described of a lamp according to the invention has a lamp filling analogous to that of the lamps known from German Patent application No. 2,023,770 referred to in the preamble with the difference that much higher tin halide concentrations are possible. A lamp filling analogous to that of the lamps known from the Netherlands Patent application No. 6610396 referred to in the preamble is used in a further preferred embodiment of a lamp according to the invention. This lamp contains tin bromide, tin iodine and furthermore optionally an excess of tin in which the halogen-tin ratio has a value of between 0.1 and 2.5 and the bromine-iodine ratio has a value of between 0.1 and 5, and has the same characteristics as the above described lamp according to the invention comprising tin chloride and tin iodide.

The colour temperature of the horizontally operating lamps according to the invention may be adjusted by suitable choice of the dosage (i.e. total halide concentration) within wide limits, for example, between 3000 and 6000K, which is of course very advantageous. An advantage of these lamps is that substantially no axis demixing of the emitted radiation occurs so that the radiation contributions originating from different parts of the discharge arc have substantially the same spectral distribution. As compared with the vertically operating lamps the horizontally operating lamps have the further advantage that they can more easily be built in luminaires.

In the horizontally operating lamps according to the invention the current conductors are preferably also used as support terminals for the discharge vessel. This makes a very simple construction possible.

The invention will now be described in greater detail with reference to a drawing.

Figure 1:
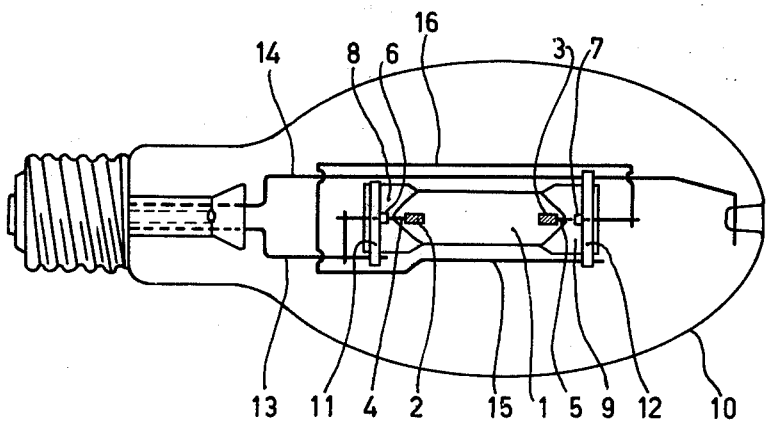
FIG. 1 is an elevational view of an embodiment of a high pressure tin halide discharge lamp according to the invention.

The lamp shown in FIG. 1 is intended for the horizontal operating position. The reference numeral 1 denotes the tubular quartz glass discharge vessel of the lamp. Tungsten electrodes 2 and 3 are present at the ends of the tube 1. The electrodes are supported by current supply wires 4 and 5 which are passed by means of molybdenum foils 6 and 7 in a vacuumtight manner through the pinches 8 and 9, respectively. The tube 1 is suspended in a glass outer envelope 10 by means of metal strips 11 and 12 which clamp about the pinches 8 and 9 and are secured to the support terminals 13 and 14, respectively, which also serve as current supply conductors for the electrodes 2 and 3, respectively. The axial section of the support terminal 14 located in the vicinity of electrode 3 is not directly connected to this electrode but is connected through the strip 12 to the wire 15 located on the lower side of the discharge vessel 1. The wire 15 is connected to the wire 16 which is parallel to a support terminal 14 in a horizontal plane above the discharge vessel 1. The end of the wire 16 is connected to the electrode 3. In this manner a winding (1.5 turns) located outside the discharge vessel is obtained through which the lamp current flows. The distance of the support terminal 14, the wire 16 and the wire 15 to the axis of the discharge is approximately 15 mm. The terminal 14 and the wire 16 may be placed above each other in a further embodiment of a lamp according to the invention on the upper side of the lamp in a vertical plane. The internal diameter of the tube 1 is approximately 15 mm and its contents are approximately 8 cubic cm. The distance between the electrodes 2 and 3 is approximately 40 mm. The lamp is intended for a load of 400 W.

EXAMPLE I

The discharge vessel of a lamp as shown in FIG. 1 was filled with argon up to a pressure of 30 Torr (at room temperature) and furthermore with

14 mg Hg
7.5 mg Sn
20 mg $HgI_2$+$HgCl_2$(ratio I/Cl=2)
0.1 mg In.

In the vertical operating position the discharge in the discharge vessel having such a dosage is found to be unstable. In the horizontal position the discharge is stable and the magnetic field generated by the current conductors is found to be sufficiently large to maintain the discharge arc in the axis of the discharge vessel. Measured at this operating position were:

radiation efficiency — $\eta = 60$ lm/W
colour temperature — Tc = 3800 K
colour rendering index — Ra = 90
colour co-ordinates — x = 0.396 y = 0.403
lamp current I — = 3.5 A A lamp not containing indium, but furthermore completely identical to the above described lamp according to the invention yielded the following measuring results:

$\eta = 60$ lm/W
Tc = 3600 K
Ra = 84
$x = 0.413$ $y = 0.424$

EXAMPLE II

A lamp as shown in FIG. 1 was provided with a filling as described in example I with the difference that the quantity of indium was 0.4 mg instead of 0.1 mg. Measured:

$\eta = 60$ lm/W
Tc = 4000 K
Ra = 93
$x = 0.384$ $y = 0.386$

EXAMPLE III

A lamp intended for a vertical operating position and with a discharge vessel having the same dimensions as the discharge vessel of FIG. 1 was filled with 30 Torr argon (room temperature) and furthermore with 25 mg Hg
4 mg Sn
14 $\mu$mol atomic chlorine
28 $\mu$mol atomic iodine
3 $\mu$mol $GaCl_3$ Measured (vertical operating position):

$\eta = 60$ lm/W
Tc = 4800 K
Ra = 90
$x = 0.350$ $y = 0.353$

The same lamp not containing $GaCl_3$(not according to the invention) yielded:

$\eta = 60$ lm/W
Tc = 4600 K
Ra = 88
$x = 0.362$ $y = 0.378$

Figure 2:
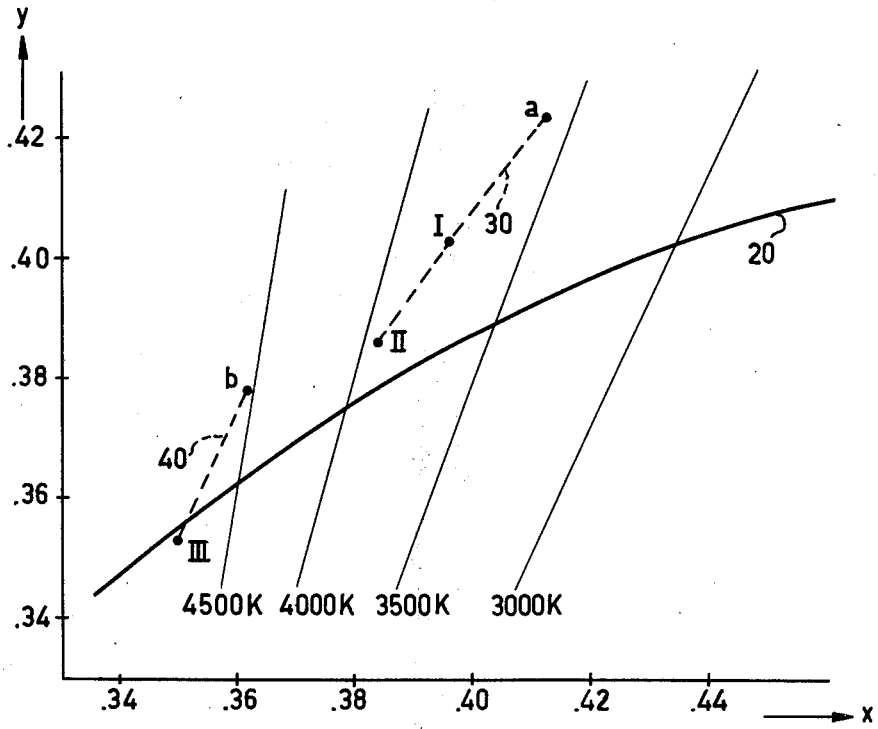
FIG. 2 shows in a graph the $x$, $y$ co-ordinates of the colour points of some lamps according to the invention.

In FIG. 2 the colour points of the lamps according to examples I, II and III are plotted in a graph. The x co-ordinate of the colour point is plotted on the horizontal axis and the y co-ordinate is plotted on the vertical axis. The reference numeral 20 denotes part of the curve of the black bodies. The straight lines denoted by 3000 K, 3500 K, 4000 K and 4500 K each indicate the collection of colour points to which the said value of the colour temperature is attributed. The colour points of the lamps of examples I and II (with indium) are denoted by I and II, respectively. Points I and II are connected by the broken line 30. The colour point *a* of the lamp without indium described in example I is also located on the line 30 (the lamp *a* is only shown for comparison and is not according to the invention). The line 30 clearly shows that addition of indium to a tin halide lamp yields a correction for the colour point. Furthermore this correction is accompanied by an increase in the colour temperature. The broken line 40 connects the colour point III of the gallium-containing lamp according to example III with the colour point *b* of the lamp without gallium mentioned in example III as a comparison (not according to the invention). Also in this case the colour point of the emitted radiation is found to shift due to the gallium addition to the curve of the black bodies so that the colour aspect of the lamp is considerably improved.

Substantially the same results as described in the examples of indium and gallium containing lamps are achieved with the elements bismuth, lead and zinc.

What is claimed is:

1. A high pressure tin halide discharge lamp having a discharge vessel provided with electrodes between which the discharge is maintained during operation, and comprising a filling of a quantity of rare gas as a starter gas and furthermore percubic cm of contents of the discharge vessel between 0 and 50 mg of mercury and at least 1 $\mu$mol of at least one of the halides of tin, characterized in that the discharge vessel comprises at least one of the substances selected from the group consisting of elemental indium, bismuth, lead, gallium and zinc and the halides of said elemental substances to correct the color point of the radiation emitted by the lamp and means for generating a magnetic field during operation which counteracts the upward curvature of the discharge arc.

2. A high pressure tin halide discharge lamp as claimed in claim 1, characterized in that the discharge vessel contents comprise for each cubic cm of volume thereof between 0.01 and 10 $\mu$mol of at least one of the elements indium, bismuth, lead, gallium and zinc.

3. A high pressure tin halide discharge lamp as claimed in claim 1, characterized in that the contents of the discharge vessel comprises substances selected from the group consisting of indium, gallium and zinc and the halides thereof.

4. A high pressure tin halide discharge lamp as claimed in Claim 1, which lamp comprises tin chloride, and tin iodide with the halogen-tin ratio being between 0.1 and 2.5 and the chlorine-iodine ratio being between 0.25 and 4, characterized in that the total quantity of tin halide has a value of between 5 and 50 $\mu$mol per cubic cm of contents of the discharge vessel, said lamp being provided with at least two current carrying members, one of said members including said means for generating a magnetic field being responsive to current flow through said members during operation when said lamp is operated with the axis thereof substantially horizontal.

5. A high pressure tin halide discharge lamp as claimed in claim 1, which lamp comprises tin bromide, and tin iodide in which the halogen-tin ratio has a value of between 0.1 and 2.5 and the bromine-iodine ratio has a value of between 0.1 and 5, characterized in that the total quantity of tin halide has a value of between 5 and 50 $\mu$mol per cubic cm of contents of the discharge vessel, the lamp including at least two current carrying members, one of said members including means for generating a magnetic field responsive to current flow through said members during operation which counteracts upward curvature of the discharge arc when said lamp is operated with the axis of said lamp in a substantially horizontal position.

6. A high pressure tin halide discharge lamp as claimed in claim 4 characterized in that the current carrying members also constitute support terminals for the discharge vessel within an outer envelope.

7. A high pressure tin halide discharge lamp as claimed in claim 5 characterized in that the current carrying members also constitute support terminals for the discharge vessel within an outer envelope.

* * * * *

UNITED STATES PATENT AND TRADEMARK OFFICE

CERTIFICATE OF CORRECTION

PATENT NO. : 4001626

DATED : January 4, 1977

INVENTOR(S) : PETER CORNELIS DROP ET AL

It is certified that error appears in the above-identified patent and that said Letters Patent are hereby corrected as shown below:

Column 5, line 24, "axis" should be --axial--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*